United States Patent [19]

Bertrand

[11] Patent Number: 4,720,861

[45] Date of Patent: Jan. 19, 1988

[54] DIGITAL SPEECH CODING CIRCUIT

[75] Inventor: John P. Bertrand, Upper Nyack, N.Y.

[73] Assignee: ITT Defense Communications a Division of ITT Corporation, Nutley, N.J.

[21] Appl. No.: 813,110

[22] Filed: Dec. 24, 1985

[51] Int. Cl.[4] ..... G10L 5/00

[52] U.S. Cl. ..... 381/36

[58] Field of Search ..... 381/31, 36, 38, 40, 381/53, 52, 35, 39, 37, 29, 32

[56] References Cited

U.S. PATENT DOCUMENTS 4,472,832 9/1984 Atol et al. ..... 381/40

4,534,055 8/1985 Iinuma ..... 381/34

OTHER PUBLICATIONS

Jayant and Noll, Digital Coding of Waveforms, Prentice Hall, 1984, pp. 622–623.

*Primary Examiner*—E. S. Matt Kemeny

*Attorney, Agent, or Firm*—Robert A. Walsh; Mary C. Werner

[57] ABSTRACT

A digital speech coding circuit makes use of linear predictive coding, vector quantization and difference, Huffman coding, and excitation estimation to produce digital representations of human speech having bit rates low enough to be transmitted over such channels as telephone lines and at the same time being capable of being synthesized in the receiver portion of the circuit to produce analog speech of high intelligibility and quality. The transmitter portion of the circuit comprises a series connection of a low pass filter, analog to digital converter, linear predictive coding module comprising five resonators for establishing five center frequencies and bandwidths of the analog speech, vector quantization module comprising binary representation of the likely combinations of resonances found in human speech, Huffman coding module, a variable bit rate to fixed bit rate converter, and optionally, an encryption module. Another branch of the transmitter circuit extends from the output of the analog to digital converter to the bit rate converter and comprises a series combination of an inverse filter and an excitation estimation module having parallel outputs respectively representative of a voiced/unvoiced signal, the excitation amplitude, and the excitation pulse position. The receiver portion of the circuit comprises a series connection of a fixed bit rate to variable bit rate converter, a bit unmapping module which produces separate outputs representative of the reflection coefficients and excitation of the speech, a synthesis filter which receives these outputs and produces a digital signal representative of the analog speech, a digital to analog converter, and a low pass filter.

7 Claims, 4 Drawing Figures

DIGITAL SPEECH CODING CIRCUIT

BACKGROUND OF THE INVENTION

The present invention relates to a circuit for digitizing analog speech, transmitting it over such channels as telephone lines, and converting it back into analog speech at the receive end.

The basic problem which has existed with regard to the digitization and transmission of analog speech is the fact that sampling the zero to three kilohertz range of human speech at a rate high enough to satisfy the Nyquist criterion of sampling at a frequency of twice the bandwidth would result in a sampling rate of approximately 8 kilohertz given the inaccuracies of typical low pass filters. Assuming that 10-bits would be sufficient to describe the amplitude of the speech wave for each sample, the required bit transmission rate would be 80 kilobits per second, a figure far in excess of the capacity of such channels as ordinary telephone lines.

A technique which has been developed to somewhat alleviate this problem is generally called linear predictive coding. Linear predictive coding (LPC) uses a parametric model of the human vocal system to encode speech. This model describes speech production as being controlled by three factors: the excitation source, the energy (or gain) of the signal, and the shape of the acoustic cavity from the epiglottis to the lips. Speech signals can either be voiced such as "a" in (ape) or unvoiced "s" in (sister). The excitation mechanism for the voiced signals is modeled by a series of pulses separated by a fixed pitch. The excitation source for the unvoiced signals is modeled as a noise generator. The shape of the acoustic cavity is represented by a plurality of resonant circuits tuned to give information regarding the natural frequencies of the analog speech.

The linear predictive coding technique takes advantage of the fact that many speech parameters will not change for a considerable number of samples during a typical speech pattern. Thus, linear predictive coding models typically use an analysis frame containing many samples to arrive at a composite profile for the speech frame before transmitting information on the channel. A commonly used analysis frame duration is 180 samples. Thus the channel bit transmission rate can be to the order of a few kilobits per second, a number which such channels as ordinary telephone lines are capable of transmitting.

The linear predictive coding technique has been discussed in the following technical papers.

A. Buzo et al., "Speech Coding Based Upon Vector Quantization", IEEE trans on ASSP, October 1980, Atal, B. S. and Remde J. M. "A New Model of LPC Excitation . . . ", Proceedings 1982 ICASS Ppp 614–617, Parker et al "Low Bit Rate Speech Enhancement . . . ", Proceedings 1984 ICASSP; pp. 1.5.1–1.5.4.

SUMMARY OF THE INVENTION

It is an object of the present invention to provide a circuit wherein analog speech is digitized and transmitted over a channel at a minimal bit rate, but yet is capable of being synthesized at the receiver end with high intelligibility and quality.

This and other objects of the invention are achieved by the provision of a multipulse linear predictive coding circuit comprising a linear predictive coding module, a vector quantization module connected to the output of the linear predictive coding module and functioning as a library containing binary representations of typical human sounds, a coding module for performing Huffman coding of a binary number, output from the vector quantization module, based on the difference between the sound presently being uttered and the previously uttered, and a variable to fixed rate conversion module connected to the output of the coding module and comprising a buffer for assembling groups of incoming bits for orderly fixed bit rate transmission on the channel. The circuit also comprises an inverse filter having inputs from the A/D converter and from the output of the vector quantization module, the inverse filter functioning to provide a residual signal which is a close digital estimation of the original excitation signal but has an excessively high bit rate, an excitation estimation module connected to the output of the inverse filter which operates on the excitation to produce signals indicating whether the sound is voiced or unvoiced, an amplitude estimate of the excitation signal, and a pulse position estimate of the excitation signal. These signals are all conveved, either directly in the case of the voice/unvoiced signal, or indirectly through quantizer modules which perform Huffman coding on the amplitude and pulse position signals, to the variable to fixed rate conversion module.

The receiver at the other end of the channel (as well as proximately to the transmitter for receiving messages from the other end), comprises a fixed to variable rate conversion module, a bit unmapping module which is programmed to receive the variably arriving bits, to organize them into meaningful assemblies, and to transmit them as both filter coefficients and excitation to a synthesis filter. The synthesis filter operates to convert the excitation and filter coefficients into a binary pattern representative of digital speech which is transmitted through a conventional digital to analog converter and low pass filter, such that intelligible and high quality analog speech may be achieved by the use of conventional devices such as earphones connected to the low pass filter.

DESCRIPTION OF THE PREFERRED EMBODIMENT

Figure 1:
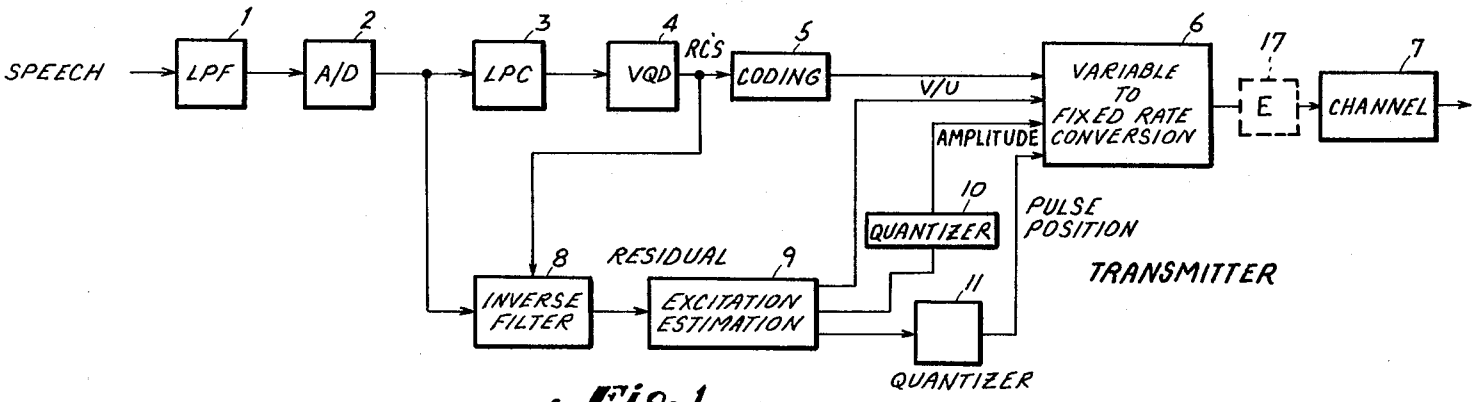
FIG. 1 is a schematic of the transmission circuit of the invention.

As shown in FIG. 1, analog speech passes through low pass filter 1 and is converted into digital form in analog to digital converter 2. The signal then proceeds to linear predictive coding module 3, which can be thought of as an adaptive whitening filter, that is a filter consisting of antiresonators, transmission zeros (five in this embodiment) that are adaptively tuned to cancel the natural resonances of the vocal tract. In analog form, the antiresonators can be implemented by RLC circuits and in digital form by non-recursive filters. The traditional implementation, preferred in this embodiment, is to perform the adaption by solving a set of linear equations that minimize the mean square error between the estimated and actual vocal tract filters. It should be clear from the foregoing that, as used herein, the term "module" does not necessarily refer only to a discrete circuit element remotely mounted from and wired to other circuit modules but also can be representative of a particular circuit function which can be accomplished together with other circuit functions in a single digital processor. The digital information from LPC module 3 is then transmitted to vector quantization and different module 4 which is essentially a library housing approximately one thousand separate combinations of bandwidths and frequencies occurring in five different resonances of natural speech. This quantity of combinations has been found to give a good representation of the various possibilities of human speech. An important feature of the vector quantization module is that it reduces the bit transmission rate by outputting a binary number based on the difference between the number designating the sound presently being analyzed and the sound immediately before it rather than outputting a binary number based on whichever of the one thousand stored combinations the analyzed signal comes closest to. More specifically, the transmission of a binary number representative of the decimal number 1,000 requires 10 bits, whereas, since the differences between adjacent sounds and human speech are usually relatively small and since the library is constructed so as to have similar sounds placed in proximity to each other, usually only a few bits will be required to describe the numerical difference between sound and the sound immediately preceding it. The reflection coefficients generated by vector quantization module 4, which are representative of the portion of the vocal tract where speech sounds are finally shaped before leaving the mouth, are then conducted to coding module 5, where Huffman coding is performed on them. The Huffman coding performed in module 5 uses few bits to describe binary codes which often occur and more bits to describe binary codes less likely to occur. A discussion of Huffman coding is found in Section 41-6 of "Reference Data For Radio Engineers", Sixth Edition, First Printing 1975, published by Howard W. Sams & Company, Inc., a subsidiary of ITT Corporation. Huffman coding of the digital signal is necessary to enable the bit unmapping module 13 of the receiver to divide the incoming variable bit stream into meaningful bit combinations. The signals are then conducted to variable to fixed rate conversion module 6 which is basically a buffer circuit for storing the incoming variable rate signals and a control loop for releasing them to channel 7 at a fixed rate and controlling the rate at which the buffer is filled.

In addition to having reflection coefficients which describe the shaping of the vocal tract to produce particular sounds, a signal representative of analog speech must also have portions representative of the sound generated at portions of the vocal tract more remote from the mouth. Such portions indicate whether the signal is voiced or unvoiced, its amplitude, and its pitch. The circuit in FIG. 1 accumulates the aforesaid portions of speech by transmitting the digital signal from the output of analog to digital converter 2 to inverse filter 8 which also has an input comprising the reflection coefficients from vector quantization modules 4. Inverse filter 8, which in digital form could comprise a shift register, multipliers, and an adder, basically comprises a plurality of antiresonator circuits which are defined herein as circuits having the capability to cancel out signals representative of the natural frequencies of the incoming analog speech and thus acts on the signal from converter 2 and the reflection coefficients to produce a digital signal which is representative of the portions of speech, including amplitude and pulse position, which are derived from the base of the human vocal system. (i.e. the vocal chords) This digital signal is conveyed to excitation estimation module 9, which acts on the signal to produce signals representative of a voiced or unvoiced signal, the amplitude of the excitation, and the pulse position of the excitation. The excitation estimation module 9 produces all of the signals at greatly reduced bit rates. With regard to the amplitude signal it can accomplish the bit reduction by such methods of analyzing a bit stream containing many samples, determining the highest amplitude sample, establishing an exponentially decaying threshold from the highest amplitude sample to which other samples can be compared, and transmitting the signals based on the number of samples exceeding the threshold during the period of analysis. Such a function could be accomplished in analog form by a bank of comparators comprising RLC circuits or in digital form by the implementation of an algorithm to find the highest amplitude value and compare it to the samples. An incidental result of the amplitude comparison is that when the number of samples that exceed the threshold is larger than a value established by the previously described control loop, the signal is characterized as unvoiced. In the case of an unvoiced signal, only the information describing the vocal tract (i.e. reflection coefficients) and the overall amplitude is transmitted. The synthesizer uses a noise generator of programmable amplitude to synthesize the appropriate sound.

A minimal bit number for indicating the pulse position of the samples in the excitation can be achieved by arbitrarily dividing a portion of the estimation signal containing many samples into a number of positions, and then assigning a binary representation for each sample. Thus, a portion of the signal divided into 180 different position indications can have each sample represented by 8 bits. This bit number can be reduced, however, by using bit representations of the numerical difference between the positions of consecutive samples.

Quantizer module 10 uses M law encoding techniques to reduce the bit rate of the amplitude signal emanating from excitation estimation module 9. Quantizer module 11 is a Huffman coding module of the type previously described and is used to reduce the bit rate of the pulse position signals emanating from the excitation estimation Module 9. These signals are then conducted to variable to fixed rate conversion module 6 from which they are transmitted onto channel 7 at a fixed rate.

Element 17, which is shown in dotted lines in FIG. 1, denotes an encryption module which can be inserted in the circuit of a secure telephone system such as the STU-3 system being developed for the U.S. Government.

Figure 2:
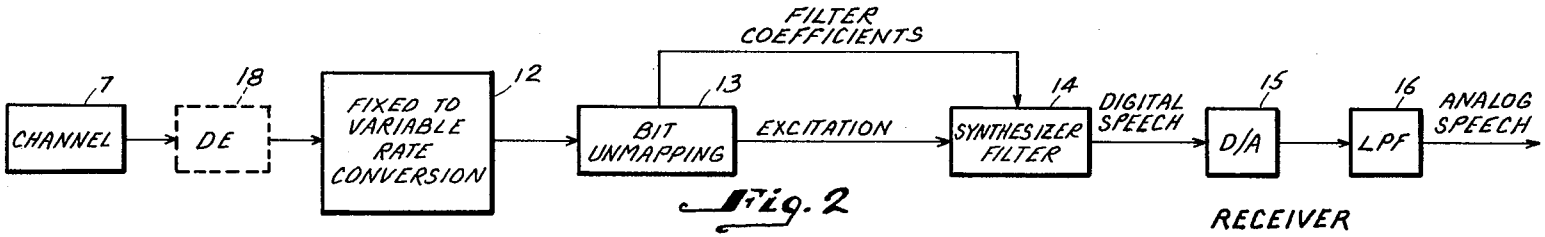
FIG. 2 is a schematic of the receiver circuit of the invention.

FIG. 2 shows the receiver circuit of the invention. As shown therein, the signal leaves channel 7, and, if encrypted, is decoded by module 18. It then proceeds to fixed to variable rate conversion module 12, which is programmed to release the digital information at variable bit rates to bit unmapping module 13. The bit unmapping module is programmed to recognize the Huffman coding and thus to decipher the incoming bit stream as to what significance each group of bits has. It operates on the signal to produce output signals representative of the filter coefficients (from which the reflection coefficients of the transmission circuit were derived) and the excitation. These signals are then applied to synthesizer filter 14, which contains five resonators which are tuned upon receiving signals from the transmitter as to what the natural frequencies of the analog speech being analyzed are, and thus works in inverse fashion to LPC Module 3, and are excited by a signal described by the received excitation to produce a digital signal representative of the entire transmitted speech pattern. This signal is then converted into analog form by digital to analog converter 15 and passes through low pass filter 16 from which it can be applied to a conventional device such as an earphone or a speaker to produce intelligible, high quality speech.

Figure 3:
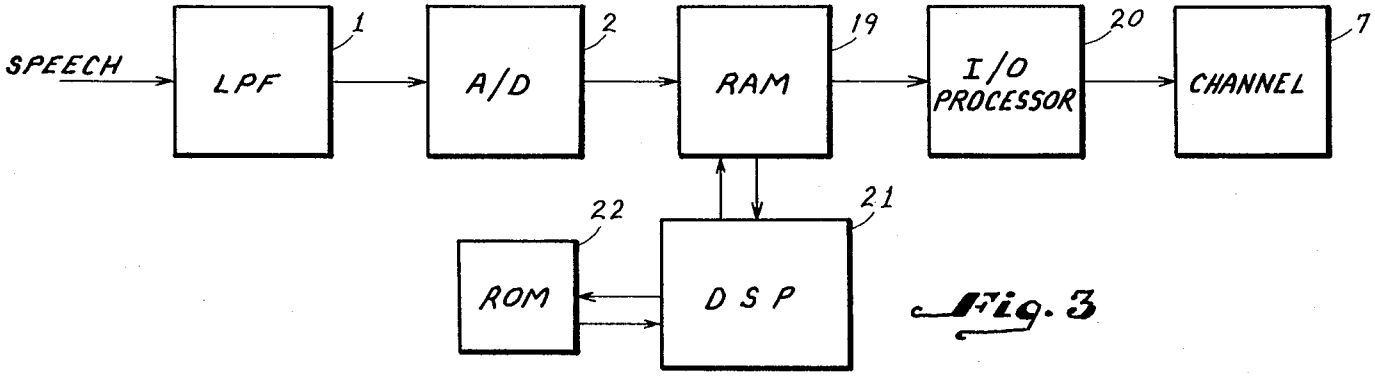
FIG. 3 is a schematic of the transmitter circuit of the invention showing a digital circuit implementation thereof.

FIG. 3 shows a digital representation of the elements of FIG. 1 with like elements having the same reference numbers. These elements are low pass filter 1, analog to digital converter 2, and the channel 7. The key element in circuit 3 is digital signal processor 21 which is programmed to perform most of the functions described with respect to the circuit of FIG. 1. An integrated circuit which may be used as the digital signal processor is the TMS-32020 manufactured by Texas Instruments. This processor can be programmed to perform the linear predictive coding analysis, vector quantization, Huffman coding, and estimation analysis described with respect to FIG. 1. The read only memory 22 can be programmed to contain such information as the values for the vector quantization "library", which are binary values representing reflection coefficients and tables containing binary values used in the Huffman coding. Random access memory 19 can be used during operation to store information such as the state of the resonator circuits and buffer circuits. It should be noted that, since the TMS-32020 processor itself contains memory, the functions of memory elements 19 and 22 may be incorporated therein.

Input/output processor 20 contains buffer circuitry for storing the bits arriving thereto at a variable rate and a control loop for releasing them to the channel at a fixed rate.

Figure 4:
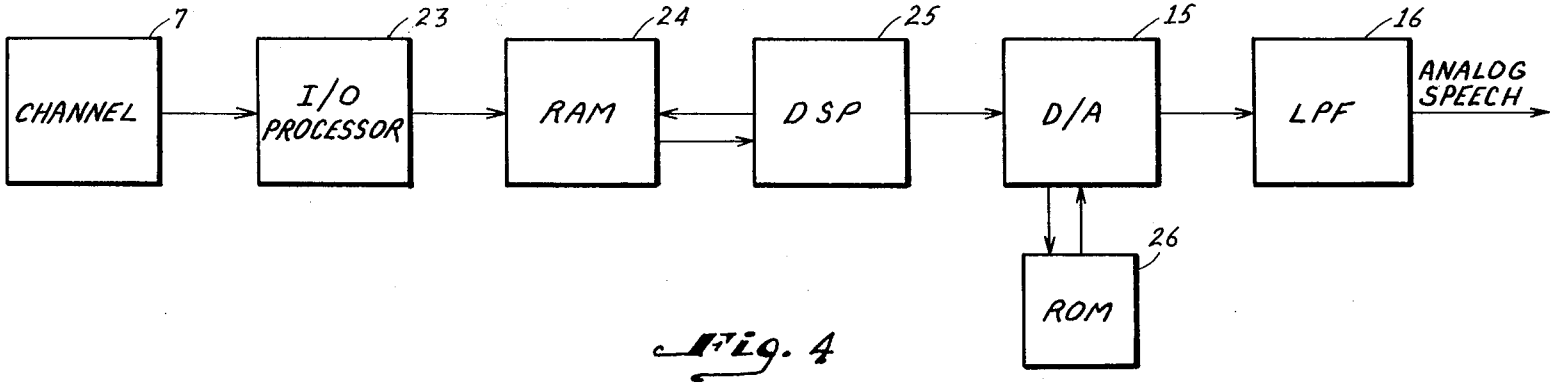
FIG. 4 is a schematic of the receiver circuit of the invention showing a digital implementation thereof.

FIG. 4 is a digital implementation of the circuitry shown in FIG. 2 with like elements being given the same reference numbers. These elements are digital to analog converter 15, low pass filter 16, and the channel 7. In this circuit input/output processor 23 contains circuitry for converting the fixed rate of the digital signal from the channel into a variable rate which is transmitted to the digital signal processor 25. The digital signal processor 25 can be embodied in the same TMS-32020 integrated circuit used in the transmitter circuit. It is programmed to perform the functions of bit unmapping to organize the bit stream into meaningful assemblies, as well as extracting filter coefficients from the digital signal as explained with reference to FIG. 2. It is also programmed to perform the resonator functions of the synthesizer filter 14 described with reference to FIG. 2. Read only memory 26 is programmed with tables containing values of the filter coefficients and tables need for the Huffman decoding of the reflection coefficients and pulse positions of the excitation. Random access memory 24 is programmed to store during operation of the circuit such information as the state of the filter resonators. Since digital signal processor 25 contains memory space, the function of elements 24 and 26 may be incorporated therein.

Algorithms for programming a digital processor to construct a digital implementation of this invention are readily available and would be easily applied by those skilled in the art. An example of an algorithm which might be used for the linear predictive coding function is:

$$\sum_{k=1}^{p} \alpha_k \phi_n(i,k) = \phi_n(i,0) \qquad i = 1,2,\ldots,p$$

where $\alpha_K$ are the unknown vector coefficients, p is the order of the model corresponding to two times the number of resonances sought since each resonance is a second degree polynomial (thus p=10 for the five resonances obtained in the preferred embodimnent), $\phi$ is the autocorrelation or covariance which is obtained by delaying a signal with respect to itself, cross multiplying the delayed signal by the original signal, and averaging out, and i indicates which of the p order equations is presently being solved. A discussion of this algorithm and its solution is found in "Digital Processing Of Speech Signals ", by L. R. Rabiner and R. W. Schafer, published by Prentice Hall (1978).

While I have described above the principles of my invention in connection with specific apparatus, it is to be clearly understood that this description is made only by way of example and not as a limitation to the scope of my invention as set forth in the objects thereof and in the accompanying claims.

What is claimed is:

1. An apparatus for converting analog speech to a digital signal for transmission on a low bit rate capacity channel, said apparatus of the type including an analog-to-digital converter for converting analog speech into digital signals with the output of said analog-to-digital converter coupled to a linear predictive coding module (LPC) for providing digital output signals at an output based on a plurality of resonances in said analog speech signal, the improvement in combination therewith of:

vector quantization means having an input coupled to said output of said linear predictive coding module and having stored therein a plurality of separate combinations of bandwidths and frequencies occurring in said plurality of resonances of said analog speech signal for providing at an output a binary number indicative of the difference between a speech sound presently being analyzed and the speech sound immediately before said analyzed sound, said binary number indicative of reflection coefficients of said speech, a coder having an input coupled to the output of said vector quantization means for providing at an output a digital signal having a lesser number of bits for often occurring reflection coefficients and a greater number of bits for less frequently occurring reflection coefficients, a variable to fixed rate converter having one input coupled to said output of said coder and operative to store said input signal from said coder at said variable rate to output said stored signal at a fixed rate according to the capacity of said channel, with said output of said converter coupled to said channel at a transmitting end.

2. The apparatus according to claim 1, wherein said coder is a Huffman coder.

3. The apparatus according to claim 1, further including:

an inverse filter having one input coupled to the output of said linear predictive coding module and another input coupled to the output of said vector quantization means to provide at an output a digital signal indicative of portions of speech in amplitude and position as derived from the vocal system and indicative of voice signals, an excitation estimator having an input coupled to the output of said inverse filter for providing at a first output digital signals indicative of voice signals and at a second output digital signals indicative of the amplitude of said voice signals and at a third output digital signals indicative of the position of said voice signals, means coupling said outputs of said excitation estimator to respective inputs of said variable to fixed rate converter to enable transmission of said signals over said channel at a fixed rate.

4. The apparatus according to claim 3, wherein said means coupling said outputs includes a first quantizer having an input coupled to said second output for providing at an output a reduced bit rate amplitude signal, and a second quantizer having an input coupled to said third output for providing a reduced bit rate position signal, with the outputs of said first and second quantizers coupled to respective inputs of said variable to fixed rate converter.

5. The apparatus according to claim 4, wherein said first quantizer is an M law encoder with said second quantizer being a Huffman coder.

6. The apparatus according to claim 5, further including receiving means coupled to said channel and operative to receive said output signal of said variable to fixed rate converter, said receiving means including a fixed to variable rate converter having an input coupled to the receiving end of said channel for providing at an output a variable bit rate signal, a bit unmapping module having an input coupled to the output of said fixed to variable rate converter and having stored therein information indicative of the coding contained in said input signal to provide at one output a signal indicative of said reflection coefficients and at a second output a signal indicative of said excitation estimator output signals, a synthesizer filer having a first input coupled to said one output of said unmapping module and a second input coupled to said second output of said unmapping module to provide at an output a digital signal indicative of said transmitted speech pattern, and a digital to analog converter having an input coupled to the output of said synthesizer filter for providing at an output an analog voice signal.

7. The apparatus according to claim 6, wherein said synthesizer filter includes a series of tuned resonators each indicative of natural voice frequencies.

* * * * *